US009434502B2

(12) United States Patent
Park

(10) Patent No.: US 9,434,502 B2
(45) Date of Patent: Sep. 6, 2016

(54) PACKING BOX FOR DISPLAY

(71) Applicant: CJ Cheiljedang Corporation, Seoul (KR)

(72) Inventor: Eun Jin Park, Seoul (KR)

(73) Assignee: CJ Cheiljedang Corporation (KR)

( * ) Notice: Subject to any disclaimer, the term of this patent is extended or adjusted under 35 U.S.C. 154(b) by 0 days.

(21) Appl. No.: 14/582,643

(22) Filed: Dec. 24, 2014

(65) Prior Publication Data

US 2016/0114932 A1 Apr. 28, 2016

(30) Foreign Application Priority Data

Oct. 22, 2014 (KR) ..... 20-2014-0007679 U

(51) Int. Cl.
*B65D 5/42* (2006.01)
*B65D 5/16* (2006.01)

(52) U.S. Cl.
CPC ..... *B65D 5/4204* (2013.01); *B65D 5/16* (2013.01)

(58) Field of Classification Search
CPC ..... B65D 2571/00283
USPC ..... 229/122, 242, 103.2, 190; 221/122, 305
See application file for complete search history.

(56) References Cited

U.S. PATENT DOCUMENTS

| | | | | |
|---|---|---|---|---|
| 7,431,163 | B2 | 10/2008 | Anderson | |
| 7,648,060 | B2 * | 1/2010 | DeBusk | B65D 71/36 206/427 |
| 8,434,288 | B2 | 5/2013 | Titkos | |
| 8,517,236 | B2 | 8/2013 | Kushner | |
| 9,162,793 | B2 * | 10/2015 | Stewart | B65D 5/724 |
| 2004/0089671 | A1 * | 5/2004 | Miller | B65D 5/5405 221/305 |
| 2005/0189405 | A1 * | 9/2005 | Gomes | B65D 71/36 229/122 |

FOREIGN PATENT DOCUMENTS

| | | | |
|---|---|---|---|
| JP | S53-121234 | U | 9/1978 |
| JP | S54-154935 | U | 10/1979 |
| JP | H02-023315 | U | 2/1990 |
| WO | WO 2014-006398 | A2 | 1/2014 |

OTHER PUBLICATIONS

Canadian Office Action dated Feb. 9, 2016 for Canadian Application No. 2,876,843.

* cited by examiner

*Primary Examiner* — Christopher Demeree
(74) *Attorney, Agent, or Firm* — Swanson & Bratschun, L.L.C.

(57) ABSTRACT

A packing box for display comprising a top plate adapted to surround the top surfaces of items disposed in the packing box; a bottom plate adapted to surround the underside surfaces of the items; a left plate adapted to surround the left surfaces of the items; and a right plate adapted to surround the right surfaces of the items.

9 Claims, 6 Drawing Sheets

PACKING BOX FOR DISPLAY

RELATED APPLICATIONS

This application claims priority to Korean application 20-2014-0007679 filed on Oct. 22, 2014 and entitled "Packing Box for Display," the content of which is hereby incorporated by reference in its entirety and for all purposes.

BACKGROUND OF THE INVENTION

1. Field of the Invention

The present invention relates to a packing box, and more particularly, to a packing box for display that is open on the front surface thereof to maximize the exposure of items disposed therein, has base parts formed on both sides of the lower end portion of the open front surface thereof to prevent the items disposed therein from falling down, and has a long slot formed on a top plate thereof to easily draw the items therefrom.

2. Background of the Related Art

Small-sized items are generally packed in a given unit.

So as to pack the small-sized items in the given unit, at this time, a packing box made of a corrugated fiberboard is generally used.

If the items are packed with the packing box, they can be easily loaded and transporting and can be protected from their damage and contamination during their storage.

When the items are packed with the packing box, however, they cannot be exposed to the outside, thus making it hard to draw a consumer's eyes on the items. In shops and selling spaces, accordingly, the packing box is open to draw items therefrom, and next, the items are displayed on a selling table or in a display case, a refrigerator and the like.

At this time, the packing box opening work, the item drawing work from the packing box, and the item displaying work are one by one conducted manually, and so as to display a large number of items or large kinds of items in shops, accordingly, long hours and high labor cost should be required.

So as to remove the above-mentioned problems, accordingly, there is provided Korean Patent No. 10-1258395 (dated on Apr. 25, 2013) disclosing a packing box having a cutting line formed on a front surface or top plate and the like thereof.

If a cutting line 60 is formed on a packing box A', as shown in FIG. 7, the packing box A' is partially separated by means of cutting along the cutting line 60 in such a manner as to be open upward, thus exposing the items disposed in the packing box A' to the outside, so that the items can be displayed through the packing box A' itself, thus removing the inconveniences caused by opening the packing box, drawing the items from the packing box, and displaying the items.

In case of the packing box A' having the cutting line 60 formed thereon, however, even if the open portion is formed on the packing box A' through the cutting along the cutting line 60, the items are not fully exposed to the outside, and further, the items disposed in the packing box A' are not stably supported and easily fall down. Furthermore, the inner surfaces of the packing box A' are brought into contact with the items, thus making it hard to draw the items from the packing box A'.

Accordingly, various endeavors have been made to develop a new packing box capable of maximizing the exposure of items disposed therein, preventing the items disposed therein from falling down, and easily drawing the items from the packing box, but until now, unfortunately, no satisfying results have been suggested.

SUMMARY OF THE INVENTION

Accordingly, the present invention has been made in view of the above-mentioned problems occurring in the prior art, and it is an object of the present invention to provide a packing box for display that is capable of removing many inconveniences and the consumption of time and labor cost caused by opening the packing box, drawing items from the packing box, and displaying the items.

It is another object of the present invention to provide a packing box for display that is capable of removing many problems that items are not fully exposed to the outside even if an open portion is formed on the packing box through the cutting along a cutting line, the items disposed in the packing box are not stably supported and easily fall down, and the inner surfaces of the packing box are brought into contact with the items to make it hard to draw the items from the packing box.

It is yet another object of the present invention to provide a packing box for display that is capable of being displayed in the state where items are packed therein, while being capable of storing and transporting the items, thus having no additional processing for the packing box for displaying the items.

To accomplish the above-mentioned objects, according to the present invention, there is provided a packing box for display including: a top plate adapted to surround the top surfaces of items disposed in the packing box; a bottom plate adapted to surround the underside surfaces of the items; a left plate adapted to surround the left surfaces of the items; and a right plate adapted to surround the right surfaces of the items; wherein the top plate has an upper side rear plate extended from the rear side end portion thereof in such a manner as to be folded downward and the bottom plate has a lower side rear plate extended from the rear side end portion thereof in such a manner as to be folded upward, the upper side rear plate and the lower side rear plate being bonded to a first rear plate bonding surface extended from the rear side end portion of the left plate in such a manner as to be folded to the right side and a second rear plate bonding surface extended from the rear side end portion of the right plate in such a manner as to be folded to the left side, thus closing the inner side rear surface of the top plate, the bottom plate, the left plate and the right plate, and opening the inner side front surface of the top plate, the bottom plate, the left plate and the right plate, and the top plate, the bottom plate, the left plate and the right plate have base parts formed on both sides of the lower end portion of the inner side open front surface thereof in such a manner as to be extended from the left plate to the bottom plate and from the right plate to the bottom plate, the top plate having a long slot extended backwardly from the intermediate front side end portion in a direction of a width thereof.

According to the present invention, desirably, the top plate has a left plate bonding surface extended from one side end portion thereof in a lengthwise direction thereof.

According to the present invention, desirably, the bottom plate has first protruding pieces formed on both sides of the front side end portion thereof.

According to the present invention, desirably, the bottom plate has first protruding pieces formed on both sides of the front side end portion thereof, the first protruding pieces having double folding lines obliquely formed thereon.

According to the present invention, desirably, the first protruding pieces are folded upward along the double folding lines to take a triangular shape.

According to the present invention, desirably, each first protruding piece has an insertion piece formed on one side end portion thereon in such a manner as to be inserted into a through hole formed between the bottom plate and the first protruding piece, thus being fixed in a folded state.

According to the present invention, desirably, the left plate and the right plate have second protruding pieces protruding from one side of the front side end portions thereof in such a manner as to be adjacent to the first protruding pieces.

According to the present invention, desirably, each second protruding piece has a triangular shape.

According to the present invention, desirably, the second protruding pieces are folded to the right side along a folding line connected between the left plate and the second protruding piece and to the left side along a folding line connected between the right plate and the second protruding piece.

According to the present invention, desirably, the base parts are formed foldably by folding and fixing the first protruding pieces.

According to the present invention, desirably, the base parts are formed foldably by folding and fixing the first protruding pieces extended from the bottom plate and the second protruding pieces extended from the left plate and the right plate.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, an explanation on a packing box for display according to the present invention will be in detail given with reference to the attached drawing.

Figure 1:
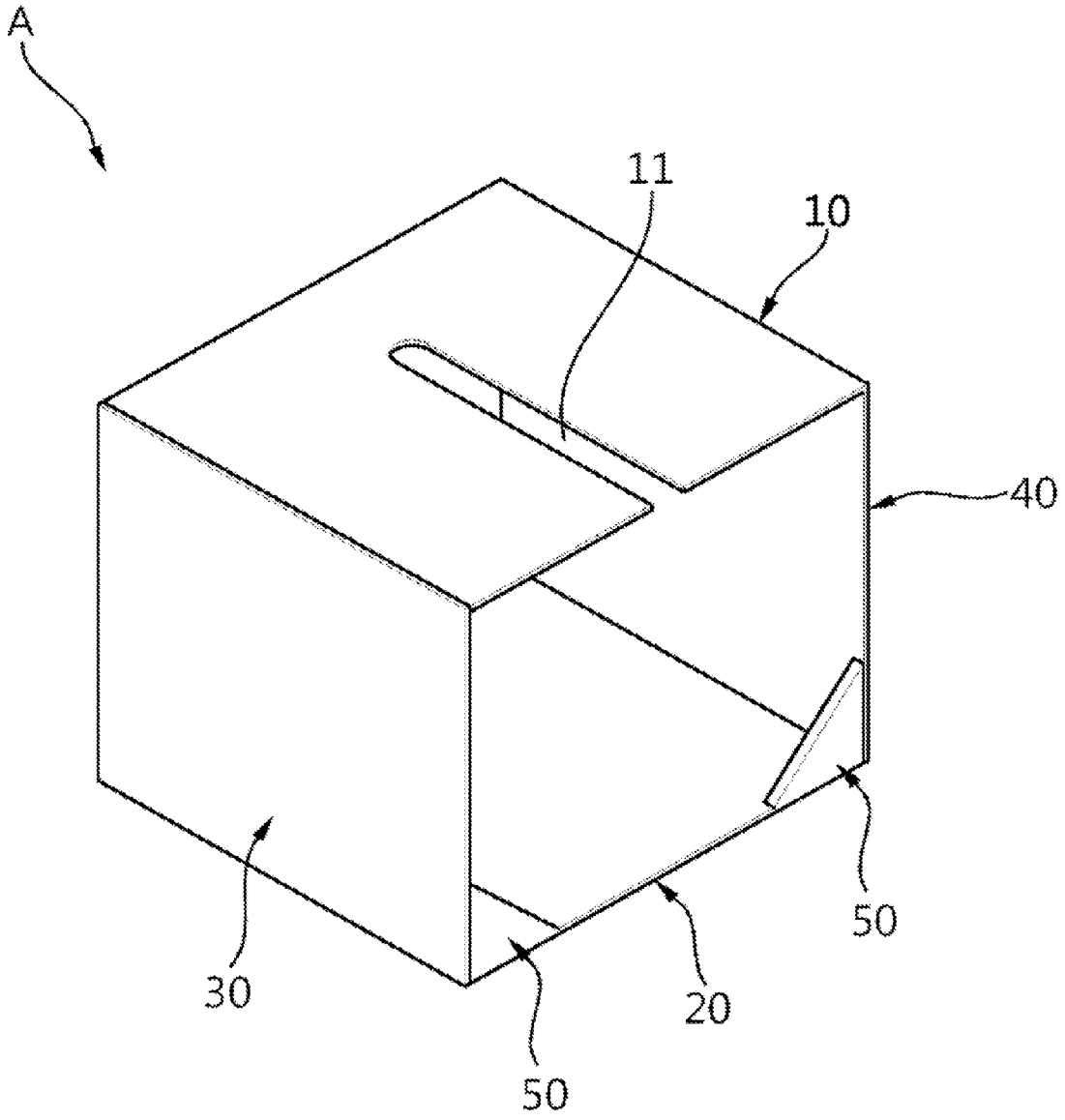
FIG. 1 is a perspective view showing an outer shape of a packing box for display according to the present invention.
Figure 2:
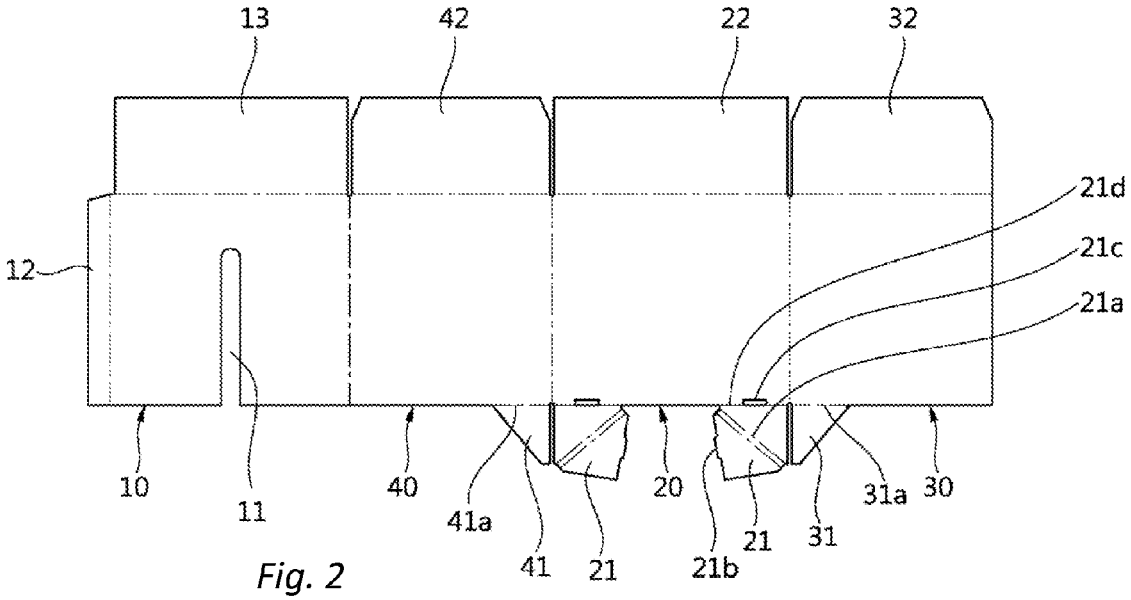
FIG. 2 is a planar figure showing the exposure of the outer surfaces of the packing box for display according to the present invention.

As shown in FIGS. 1 and 2, a packing box A for display according to the present invention includes a top plate 10, a bottom plate 20, a left plate 30, and a right plate 40.

The top plate 10 serves to surround the top surfaces of items 100.

The top plate 10 desirably has a long slot 11 extended backwardly from the intermediate front side end portion in a direction of a width thereof.

As a result, a user's finger can be inserted under the top plate 11 through the long slot 11 extended backwardly from the intermediate front side end portion in the direction of the width of the top plate 11, thus allowing the items 100 located under the top plate 11 to be easily drawn from the packing box A. In this case, the intermediate front side end portion of the top plate 10 does not mean the right center front side end portion. Only if the user's finger is inserted into the long slot 11 to draw the items 100 from the packing box A, the long slot 11 may be formed in every position.

Further, the top plate 10 has a left plate bonding surface 12 extended from one side end portion thereof in a lengthwise direction thereof. As the left plate bonding surface 12 is bonded to the inner surface of the top side end portion of the left plate 30, the top plate 10 is rigidly connected to the left plate 30. FIG. 2 shows the case wherein the top plate 10 and the left plate 30 are connected to each other by means of the left plate bonding surface 12, but according to the present invention, the bonding surface for connecting the top plate 10, the bottom plate 20, the left plate 30 and the right plate 40 surrounding the items 100 may be formed extended from one side end portion of any one of the top plate 10, the bottom plate 20, the left plate 30 and the right plate 40 in the lengthwise direction thereof.

Further, the top plate 10 has an upper side rear plate 13 extended from the rear side end portion thereof.

As a result, the upper side rear plate 13 is folded downward from the top plate 10 to allow the upper portion of the rear side of the top plate 10 corresponding thereto to be closed thereby.

The bottom plate 20 serves to surround the underside of the items 100.

The bottom plate 20 desirably has first protruding pieces 21 formed on both sides of the front side end portion thereof, and each of the first protruding pieces 21 has a double folding line 21*a* formed thereon. As shown in FIG. 2, the double folding lines 21*a* are formed obliquely.

The first protruding pieces 21 are formed on both sides of the front side end portion of the bottom plate 20, and the first protruding pieces 21 are folded to form foldable base parts 50 extended from the bottom plate 20. In more detail, the double folding lines 21*a* are formed on the first protruding pieces 21, and the first protruding pieces 21 are folded along the double folding lines 21*a* to form the foldable base parts 50 extended from the bottom plate 20.

The double folding lines 21*a* of the first protruding pieces 21 are formed obliquely, so that the first protruding pieces 21 are folded along the double folding lines 21*a* to take a triangular shape.

Accordingly, the base parts 50 formed by folding the first protruding pieces 21 take a triangular shape, so that the base parts 50 can minimize the blocking area on the exposure of the items 100 according to their shape characteristics.

Further, the first protruding pieces 21 have folding lines 21*d* formed between the bottom plate 20 and the first protruding pieces 21, so that they can be folded upward.

The first protruding pieces 21 are folded upward by means of the folding lines 21*d*, so that the base parts 50 can be located on top of the bottom plate 20.

Further, each first protruding piece 21 desirably has an insertion piece 21*b* extended from one side end portion thereof and a through hole 21*c* formed between the bottom plate 20 and the first protruding piece 21.

As a result, as the insertion piece 21*b* is inserted into the through hole 21*c*, the first protruding piece 21 folded to the triangular shape can be fixed to the folded state.

On the other hand, the bottom plate 20 has a lower side rear plate 22 extended from the rear side end portion thereof.

As a result, the lower side rear plate 22 is folded upward from the bottom plate 20 to allow the upper portion of the rear side of the bottom plate 20 corresponding thereto to be closed thereby.

The left plate 30 serves to surround the left side of the items 100 and the right plate 40 to surround the right side of the items 100.

The left plate 30 and the right plate 40 desirably have second protruding pieces 31 and 41 protruding from one side of the front side end portions thereof in such a manner as to be adjacent to the first protruding pieces 21.

As a result, the second protruding pieces 31 and 41, which are formed protrudingly from one side of the front side end portions thereof in such a manner as to be adjacent to the first protruding pieces 21, are inserted into the inside of the first protruding pieces 21, thus supporting the first protruding pieces 21 thereagainst.

At this time, the second protruding pieces 31 and 41 have the same shape as the first protruding pieces 21, and in more detail, the second protruding pieces 31 and 41 have a triangular shape.

That is, as shown in FIG. 2, the second protruding pieces 31 and 41 have the triangular shape, and accordingly, they are inserted into the inside of the first protruding pieces 21 folded to the triangular shape, while being closely contacted with the first protruding pieces 21.

In this case, the second protruding piece 31 is folded to the right side along a folding line 31*a* connected between the left plate 30 and the second protruding piece 31, and the second protruding piece 41 is folded to the left side along a folding line 41*a* connected between the right plate 30 and the second protruding piece 41, so that the second protruding pieces 31 and 41 are inserted into the inside of the first protruding pieces 21 located on the top of the bottom plate 20.

On the other hand, the left plate 30 has a first rear plate bonding surface 32 extended from the rear side end portion thereof.

As a result, the first rear plate bonding surface 32 formed on the rear side end portion of the left plate 30 is folded to the right side, and the upper side rear plate 13 and the lower side rear plate 22 are bonded to the first rear plate bonding surface 32, so that the upper side rear plate 13 and the lower side rear plate 22 are fixed to the first rear plate bonding surface 32.

Further, the right plate 40 has a second rear plate bonding surface 42 extended from the rear side end portion thereof.

As a result, the second rear plate bonding surface 42 formed on the rear side end portion of the right plate 40 is folded to the left side, and the upper side rear plate 13 and the lower side rear plate 22 are bonded to the second rear plate bonding surface 42, so that the upper side rear plate 13 and the lower side rear plate 22 are fixed to the second rear plate bonding surface 42.

Now, an explanation on the display using the packing box A for display according to the present invention will be in detail given.

Figure 3:
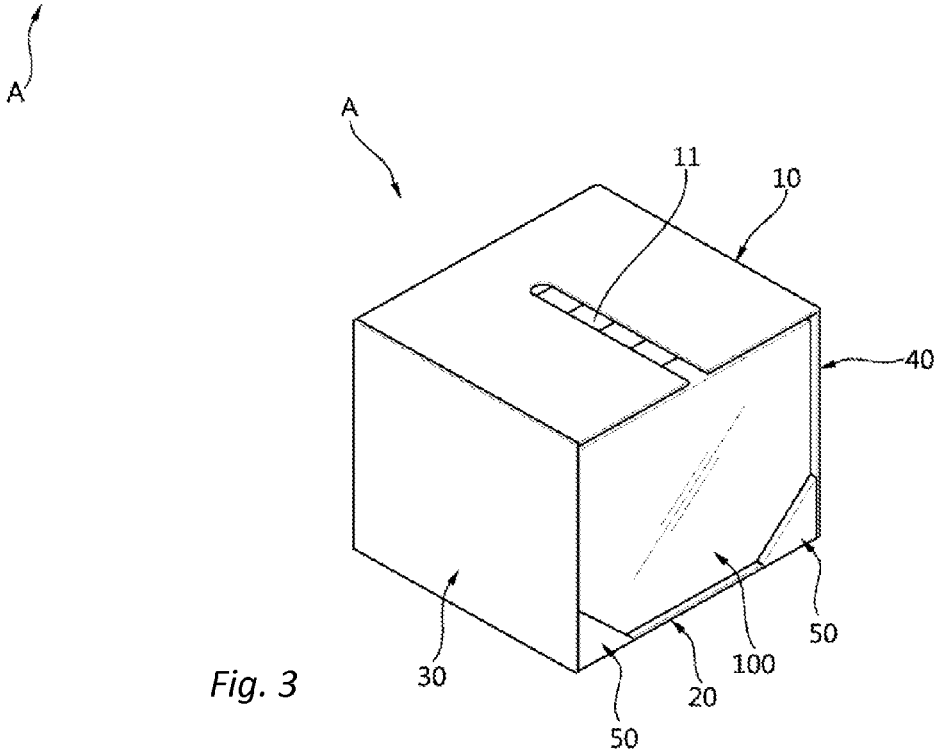
FIG. 3 is a perspective view showing the exposure of items through the open front surface of the packing box for display according to the present invention.

According to the present invention, the packing box A is closed on the rear surface thereof and open on the front surface thereof. As shown in FIG. 3, the items 100 contained in the packing box A are exposed to the open front surface of the packing box A.

Accordingly, the packing box A itself is displayed on a selling table or in a display case, a refrigerator and the like, thus displaying the items 100.

At this time, the base parts 50 are formed on both sides of the lower portion of the open front surface of the packing box A, thus limiting the exposure of the items 100, but according to the present invention, they are formed to a minimum shape, for example, to a triangular shape, thus minimizing the blocking area on the exposure of the items 100, so that even if the base parts 50 are formed, one surface of each item 100 can be fully exposed to the outside through the open front surface of the packing box A.

When the items 100 are exposed to the outside through the open front surface of the packing box A, however, if they have a relatively small width, they are unstably erected and fall forward through the open front surface of the packing box A, thus undesirably causing bad display state.

Figure 4:
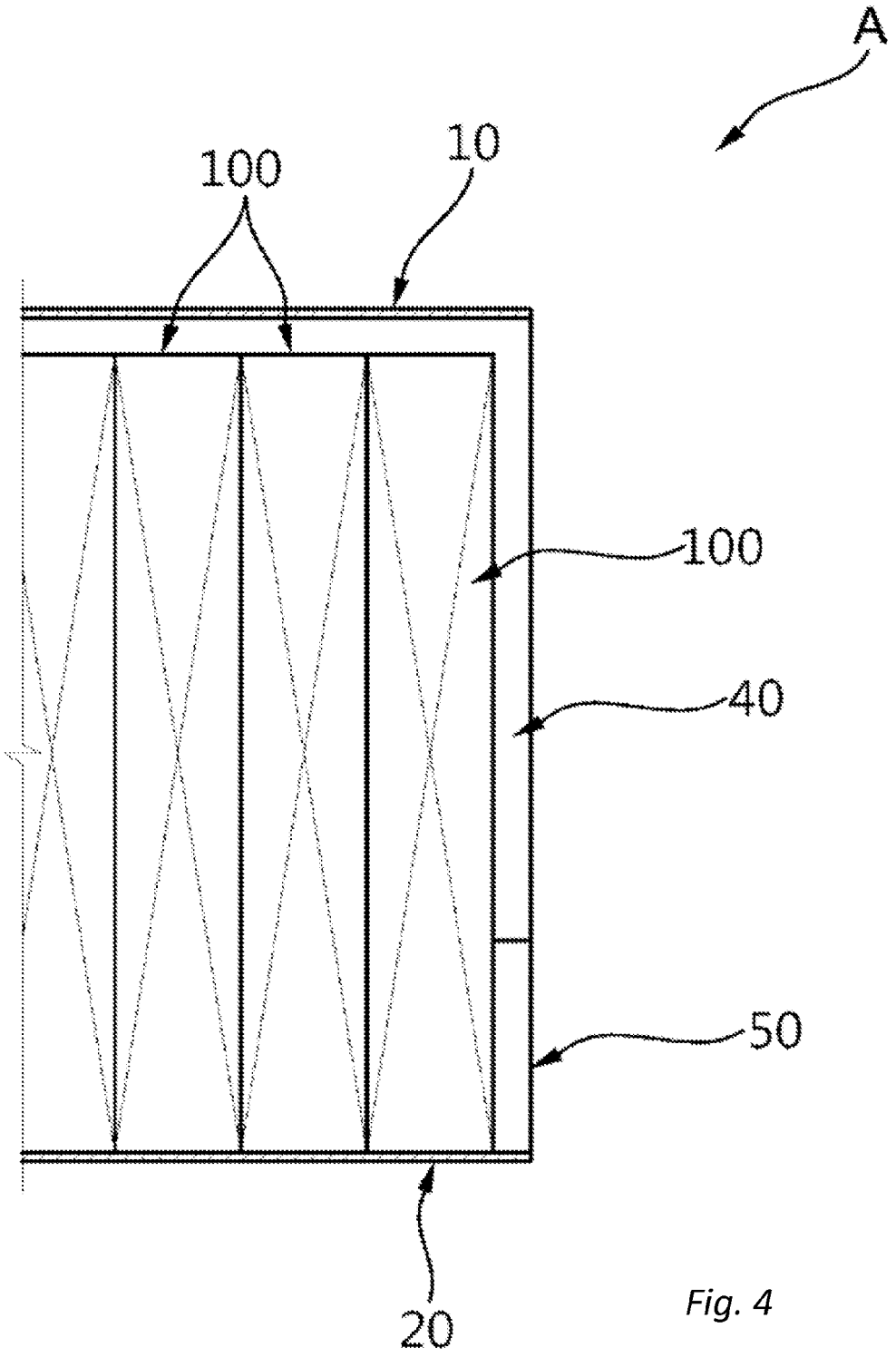
FIG. 4 is a side view showing the supporting state for items through base parts of the packing box for display according to the present invention.

According to the present invention, however, the base parts 50 are formed on both sides of the lower portion of the open front surface of the packing box A, and as shown in FIG. 4, they support both sides of the lower end portion of the front surface of each item 100 exposed to the outside through the open front surface of the packing box A, thus preventing the items 100 from falling forward from the inside of the packing box A.

At this time, if the base parts 50 formed on both sides of the lower portion of the open front surface of the packing box A are weak and easily moved, the items 100 cannot be stably supported against the base parts 50.

According to the present invention, however, the base parts 50 are formed by folding the first protruding pieces 21 and folding and fixing the second protruding pieces 31 and 41 extended from the left plate 30 and the right plate 40 to the inside of the first protruding pieces 21, which makes them rigidly formed, so that the items 100 can be stably supported against the base parts 50.

Figure 6:
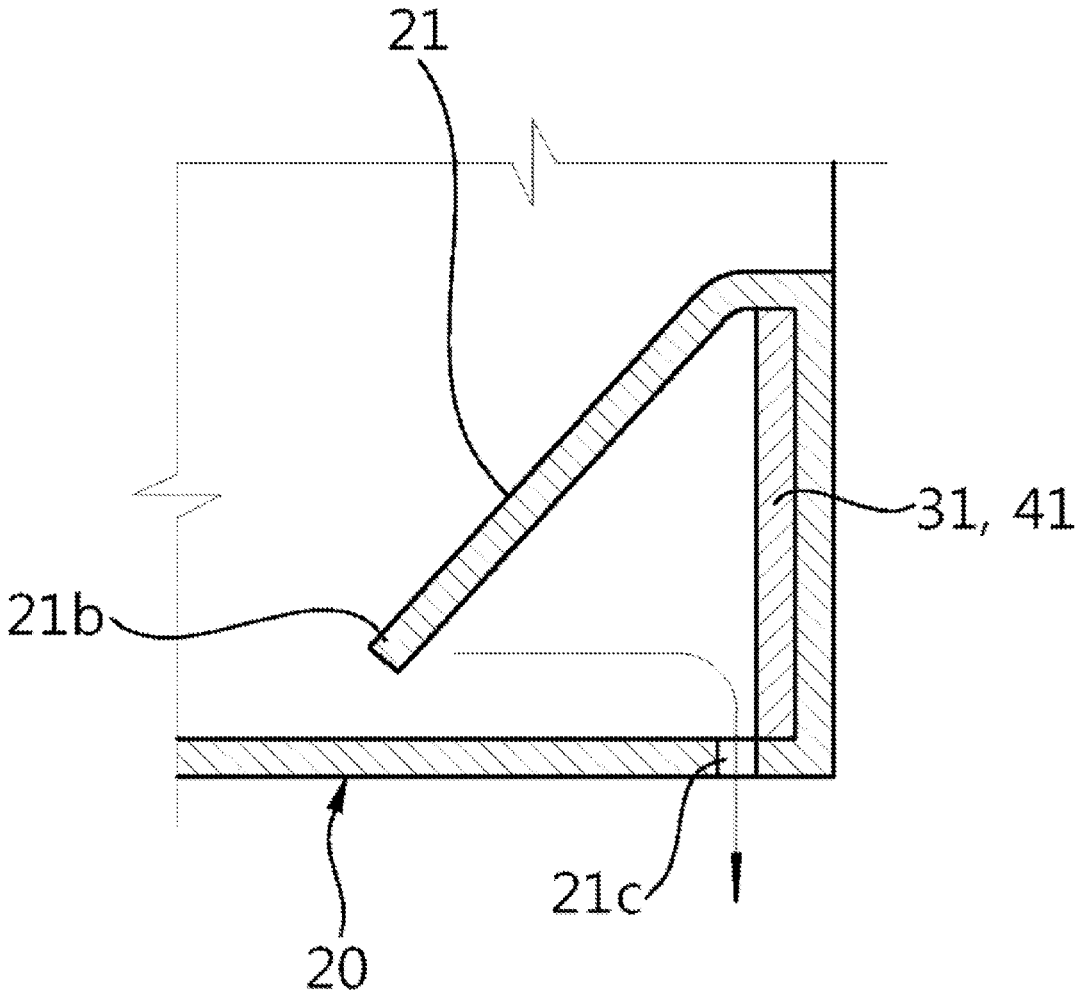
FIG. 6 is a side view showing the base parts of the packing box for display according to the present invention.
Figure 7:
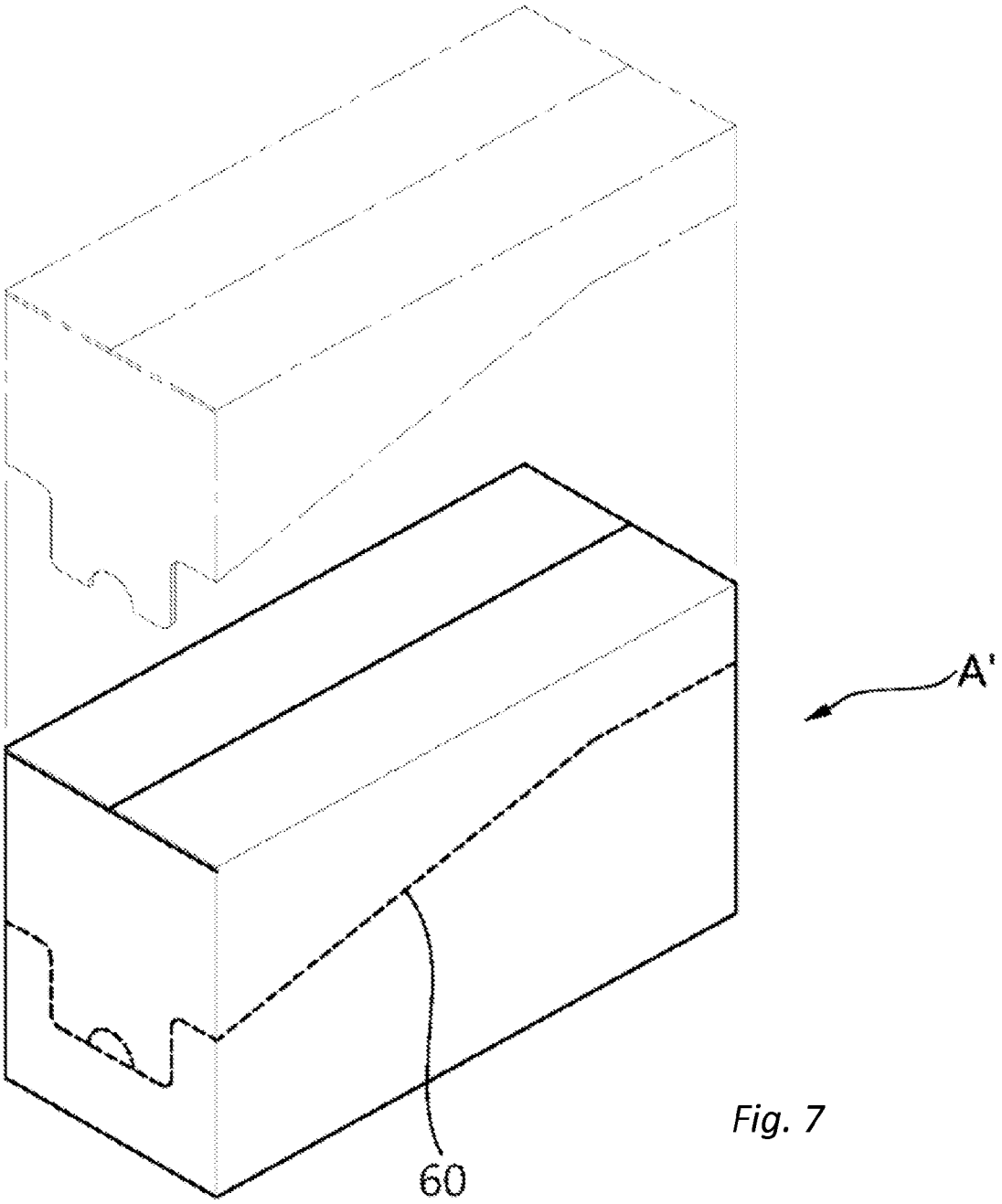
FIG. 7 is a perspective view showing a conventional packing box having a cutting portion formed thereon.

That is, the second protruding pieces 31 and 41 extended from the left plate 30 and the right plate 40 are folded to the inside of the packing box A, and as shown in FIG. 6, the first protruding pieces 21 formed on the bottom plate 20 are folded to cover the second protruding pieces 31 and 41. After that, the insertion pieces 21*b* of the first protruding pieces 21 are fixedly inserted into the through holes 21*c*, thus forming the base parts 50. The first protruding pieces 21 extended from the bottom plate 20 are connected to the left plate 30 and the right plate 40 by means of the insertion of the second protruding pieces 31 and 41, so that the base parts 50 become rigid, without being moved, thus stably supporting the items 100 thereagainst.

On the other hand, the inner surfaces of the packing box A are brought into close contact with the outer surfaces of the items 100, thus making it hard to draw the items 100 from the packing box A.

Figure 5:
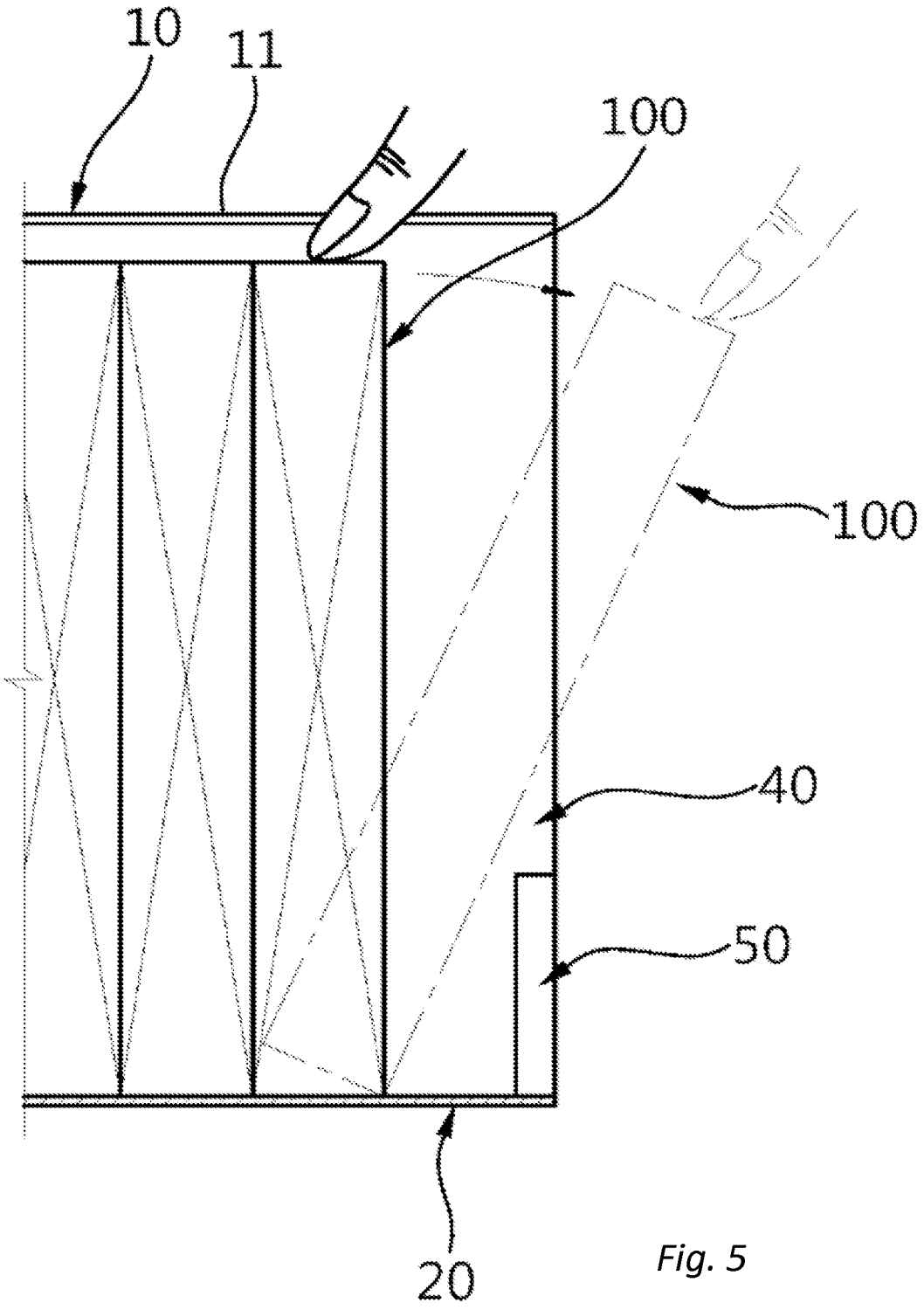
FIG. 5 is a side view showing the drawing of the items from a long slot of the a packing box for display according to the present invention.

According to the present invention, however, the top plate 11 has the long slot 11 extended backwardly from the intermediate front side end portion in the direction of the width thereof, and accordingly, as shown in FIG. 5, the user's finger can be inserted into the long slot 11 under the top plate 11, thus allowing the items 100 located under the top plate 11 to be easily drawn from the packing box A.

As mentioned above, the packing box A for display according to the present invention is open on the front surface thereof and has the base parts 50 formed on both sides of the lower end portion of the open front surface thereof and the long slot 11 formed on the top plate 10 thereof, thus fully exposing one surface of each item 100 to the outside through the open front surface of the packing box A to maximize the exposure of the item 100 being displayed, stably supporting the items 100 through the base parts 50 to prevent the items 100 disposed in the packing box A from falling forward, and pulling the item 100 through the insertion of the user's finger into the long slot 11 under the top plate 10 to easily draw the items 100 from the packing box A.

As described above, the packing box for display according to the present invention is open on the front surface thereof, thus fully exposing one surface of each item to the outside through the open front surface thereof, so that even if the packing box itself is displayed, the item can be exposed to the outside to a maximum degree.

Additionally, the packing box for display according to the present invention has the base parts formed on both sides of the lower end portion of the open front surface thereof, thus stably supporting the items through the base parts to prevent the items disposed in the packing box from falling forward.

Further, the packing box for display according to the present invention has the long slot formed on the top plate thereof to pull the items through the insertion of the user's finger into the long slot under the top plate, thus easily drawing the items from the packing box.

Furthermore, the packing box for display according to the present invention is displayed in the state where items are packed therein, while also storing and transporting the items, thus having no additional processing for the packing box for displaying the items.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A packing box for display comprising:

a top plate adapted to surround a top surfaces of items disposed in the packing box;

a bottom plate adapted to surround an underside surfaces of the items;

a left plate adapted to surround a left surfaces of the items; and a right plate adapted to surround a right surfaces of the items;

wherein the top plate has an upper side rear plate extended from a rear side end portion thereof in such a manner as to be folded downward and the bottom plate has a lower side rear plate extended from the rear side end portion thereof in such a manner as to be folded upward, the upper side rear plate and the lower side rear plate being bonded to a first rear plate bonding surface extended from a rear side end portion of the left plate in such a manner as to be folded to the right side and a second rear plate bonding surface extended from the rear side end portion of the right plate in such a manner as to be folded to the left side, thus closing an inner side rear surface of the packing box, and thus opening an inner side front surface of the packing box and the packing box further having base parts formed on both sides of the lower end portion of an inner side open front surface thereof in such a manner as to be extended from the left plate to the bottom plate and from the right plate to the bottom plate, the top plate having a long slot extended backwardly from an intermediate front side end portion in a direction of a width thereof wherein the long slot defines an opening in the top plate having a slot width that is less than a width of the top plate, and wherein the long slot provides for user manipulation of one or more items through the long slot to remove the one or more items from the packing box through an opening that is not the long slot;

wherein the bottom plate comprises at least one first protruding piece extending from a base fold line between a front side end portion of the bottom plate and the first protruding piece, said first protruding piece comprising;

an oblique fold line formed across the first protruding piece, and an insertion tab formed on a side end portion of the first protruding piece, wherein the insertion tab is inserted into a hole formed between the bottom plate and the first protruding piece.

2. The packing box for display according to claim 1, wherein the top plate has a left plate bonding surface extended from one side end portion thereof in a lengthwise direction thereof.

3. The packing box for display according to claim 1, wherein the oblique fold line causes the first protruding piece to be fixed as a substantially triangular base part extending upward from the bottom plate when the first protruding piece is folded upward at the base fold line, folded across the oblique fold line and the insertion tab is inserted into a hole formed between the bottom plate and the first protruding piece.

4. The packing box for display according to claim 1, wherein the bottom plate has left and right first protruding pieces formed on both sides of the front side end portion thereof, and the left plate and the right plate have left and right second protruding pieces protruding from one side of a front side end portion of each of the left plate and the right plate, adjacent to the corresponding first protruding pieces.

5. The packing box for display according to claim 4, wherein each second protruding piece has a triangular shape.

6. The packing box for display according to claim 4, wherein the left second protruding piece is folded to the right side along a folding line between the left plate and the left second protruding piece and the right second protruding piece is folded to the left side along a folding line between the right plate and the right second protruding piece.

7. The packing box for display according to claim 4, wherein left and right substantially triangular base parts are formed by folding each of the left and right protruding pieces over the adjacent second protruding piece at the oblique fold line and thereby fixing the second protruding pieces within the substantially triangular base parts.

8. The packing box for display according to claim 1, wherein the long slot provides for user manipulation of one or more items through the long slot to remove the one or more items from the packing box through the opened inner side front surface of the packing box.

9. The packing box for display according to claim 1, wherein the substantially triangular base part covers less than one half of the opened inner side front surface of the packing box.

* * * * *